US010953659B2

(12) United States Patent
Harai

(10) Patent No.: US 10,953,659 B2
(45) Date of Patent: Mar. 23, 2021

(54) PRINTING APPARATUS AND CONTROL METHOD OF PRINTING APPARATUS

(71) Applicant: CANON KABUSHIKI KAISHA, Tokyo (JP)

(72) Inventor: Yuriko Harai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/529,913

(22) Filed: Aug. 2, 2019

(65) Prior Publication Data

US 2020/0047510 A1 Feb. 13, 2020

(30) Foreign Application Priority Data

Aug. 7, 2018 (JP) ..... JP2018-148711

(51) Int. Cl.
*B41J 2/175* (2006.01)

(52) U.S. Cl.
CPC ..... *B41J 2/17509* (2013.01); *B41J 2/1752* (2013.01); *B41J 2/17546* (2013.01); *B41J 2002/17576* (2013.01)

(58) Field of Classification Search
CPC ..... B41J 2/17543
See application file for complete search history.

(56) References Cited

U.S. PATENT DOCUMENTS 5,493,107 A * 2/1996 Gupta ..... G06K 1/121 235/383
6,142,600 A 11/2000 Takahashi et al.
6,155,664 A * 12/2000 Cook ..... B41J 2/17509 347/19
6,561,635 B1 * 5/2003 Wen ..... B41J 2/175 347/85
7,663,780 B2 * 2/2010 Lapstun ..... B41J 2/17503 358/1.8
8,801,158 B2 8/2014 Honoki
9,545,795 B2 1/2017 Nie et al.
9,757,950 B2 9/2017 Nie et al.
2005/0057620 A1 * 3/2005 Kimura ..... B41J 2/17543 347/85

(Continued)

FOREIGN PATENT DOCUMENTS

EP 1 219 441 A2 7/2002
JP 2015166185 A 9/2015

OTHER PUBLICATIONS

Extended European Search Report dated Jan. 16, 2020, in European Patent Application No. 19190474.7.

*Primary Examiner* — Shelby L Fidler
(74) *Attorney, Agent, or Firm* — Venable LLP

(57) ABSTRACT

A printing apparatus that replenishes ink by exchanging an exchange ink tank includes a code reader for inputting ink information representing an ink type, a float sensor for detecting that the exchange ink tank has changed to an empty state, and a main controller. The main controller determines that the exchange ink tank can be exchanged if the float sensor detects that the exchange ink tank is in the empty state, and if first ink information associated with the exchange ink tank and second ink information associated with an installation location of the exchange ink tank, which are input by the code reader, are compared, and it is determined that the first ink information and the second ink information are compatible.

11 Claims, 6 Drawing Sheets

(56) References Cited

U.S. PATENT DOCUMENTS

| | | | | |
|---|---|---|---|---|
| 2006/0124662 | A1* | 6/2006 | Reynolds | B41J 2/17506 222/23 |
| 2012/0026546 | A1* | 2/2012 | Miura | B41J 2/17556 358/1.15 |
| 2012/0098901 | A1 | 4/2012 | Asauchi | |
| 2013/0120491 | A1 | 5/2013 | Maru et al. | |
| 2014/0307015 | A1 | 10/2014 | Nie et al. | |

* cited by examiner

PRINTING APPARATUS AND CONTROL METHOD OF PRINTING APPARATUS

BACKGROUND OF THE INVENTION

Field of the Invention

The present invention relates to a printing apparatus and a control method of the printing apparatus.

Description of the Related Art

For ink tank exchange in a printing apparatus, there is conventionally provided a method of determining, using a sensor, a cartridge shape, or the like, whether an ink tank is correctly set at a predetermined position.

For example, in a technique disclosed in Japanese Patent Laid-Open No. 2015-166185, a printing apparatus main body is provided with a light-receiving portion that senses light and a facility electrical contact used to communicate with an information storage device, and an ink cartridge is provided with a light-emitting portion corresponding to the light-receiving portion. When the ink cartridge is attached, and a light emission instruction for an optical signal including the identification information of the ink cartridge is issued, cartridge information acquired when the light-receiving portion senses the light emission is compared with cartridge information in the information storage device, thereby determining the presence/absence of an attachment error.

However, in the method of Japanese Patent Laid-Open No. 2015-166185, the attachment error can be detected only after the attachment of the cartridge. Hence, an ink cartridge of a wrong ink type may be set temporarily.

Furthermore, in Japanese Patent Laid-Open No. 2015-166185, if the ink type of the cartridge attachment portion matches that of the cartridge main body, exchange can be done even if a sufficient amount of ink remains.

SUMMARY OF THE INVENTION

The present invention has been made in consideration of the above-described conventional technique, and has as its object to implement prevention of an ink tank attachment error and prevention of unwanted ink tank exchange.

In order to achieve the above object, the present invention has the following arrangement.

That is, according to an aspect of the present invention, there is provided a printing apparatus that replenishes ink by exchanging an exchange ink tank, comprising: an input unit configured to input ink information representing an ink type; a detection unit configured to detect that the exchange ink tank has changed to an empty state; and a control unit, wherein the control unit determines that the exchange ink tank can be exchanged if the detection unit detects that the exchange ink tank is in the empty state, and if first ink information associated with the exchange ink tank and second ink information associated with an installation location of the exchange ink tank, which are input by the input unit, are compared, and it is determined that the first ink information and the second ink information are compatible.

According to the present invention, prevention of an ink tank attachment error and prevention of unwanted ink tank exchange are implemented.

Further features of the present invention will become apparent from the following description of exemplary embodiments with reference to the attached drawings.

DESCRIPTION OF THE EMBODIMENTS

Embodiments of the present invention will be described with reference to the accompanying drawings. In each view, arrows X and Y indicate horizontal directions perpendicular to each other. An arrow Z indicates a vertical direction.

<Printing System>

Figure 1:
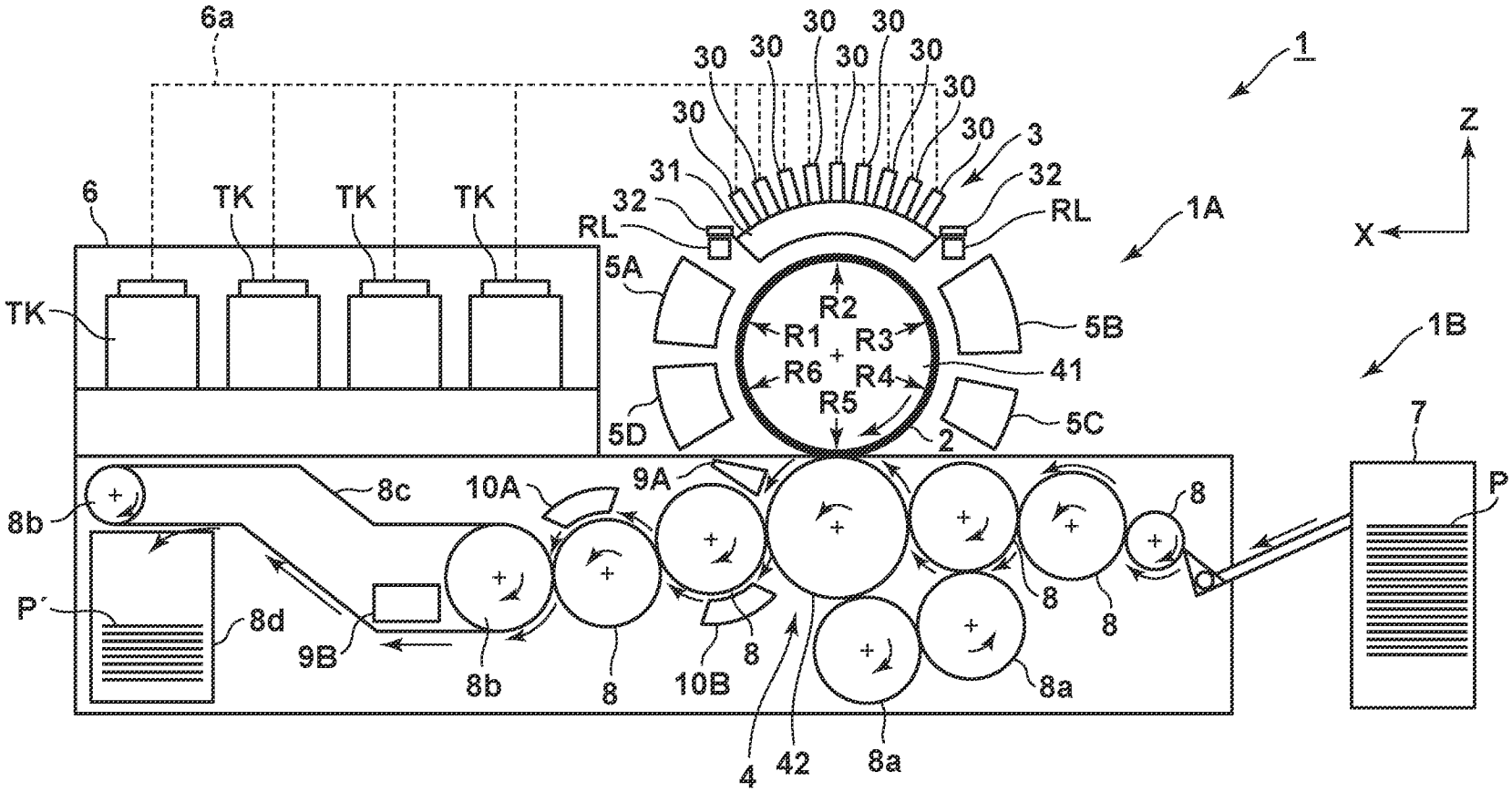
FIG. 1 is a schematic view showing a printing system.

FIG. 1 is a front view schematically showing a printing system 1 according to an embodiment of the present invention. The printing system 1 is a sheet inkjet printer that forms (manufactures) a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction. The printing apparatus 1A performs printing using ink stored in the buffer tank of a reservoir. The ink in the buffer tank is replenished from an exchange ink tank. The exchange ink tank is exchangeable. New ink can be replenished by exchanging an empty exchange ink tank with a new exchange ink tank filled with ink in the installation location.

Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "print media" are assumed to be paper sheets but may be fabrics, plastic films, and the like. An ink component is not particularly limited. In this embodiment, however, a case is assumed in which aqueous pigment ink that includes a pigment as a coloring material, water, and a resin is used.

<Printing Apparatus>

The printing apparatus 1A includes a print unit 3, a transfer unit 4, peripheral units 5A to 5D, and a supply unit 6.

<Print Unit>

Figure 2:
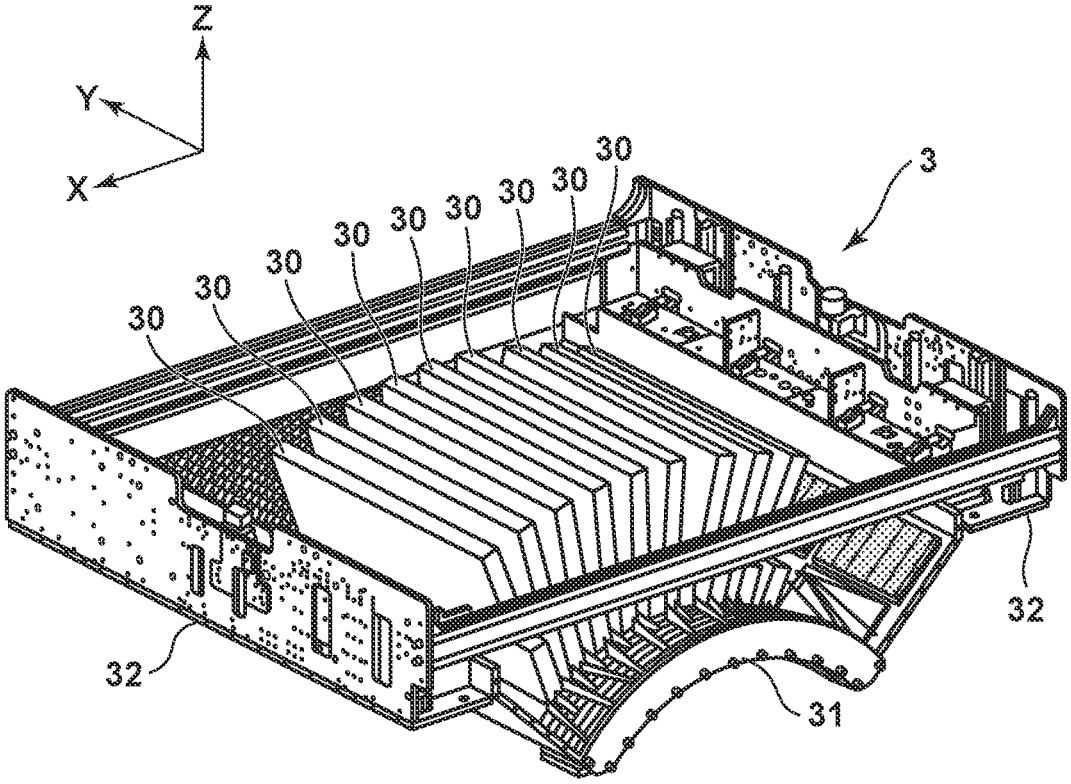
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

<Transfer Unit>

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

<Peripheral Units>

The peripheral units 5A to 5D are arranged around the transfer drum 41. In this embodiment, the peripheral units 5A to 5D are specifically an application unit, an absorption unit, a heating unit, and a cleaning unit in the listed order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or attach physically by contacting the component that increases the ink viscosity, thereby causing the increase in ink viscosity. This increase in ink viscosity includes not only a case in which an increase in viscosity of the entire ink is caused, but also a case in which a local increase in viscosity is generated by coagulating some of the components, such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism that absorbs the liquid component from the ink image on the transfer member 2 before transfer. When the liquid component of the ink image is decreased, bleeding or the like of an image printed on the print medium P can be suppressed. From another viewpoint, the decrease of the liquid component can also be expressed as condensing the ink of the ink image on the transfer member 2. Condensing ink means that the liquid component contained in the ink image decreases, and the content ratio of a solid content such as a coloring material or a resin contained in the ink to the liquid component increases.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. The reservoir TK may be formed by a plurality of tanks. In this example, the reservoir TK includes a buffer tank fixed to the printing apparatus 1A, and an exchange ink tank that is a tank used to replenish ink for the buffer tank and is exchangeable. If the remaining ink amount in the buffer tank is sufficient, the exchange ink tank may be detached. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing include, for example, coating that aims at protection, glossy imparting glossiness, and the like of an image on the image printed surface of the printed product P'. For example, liquid application, sheet welding, lamination, and the like can be given examples of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images on every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 3:
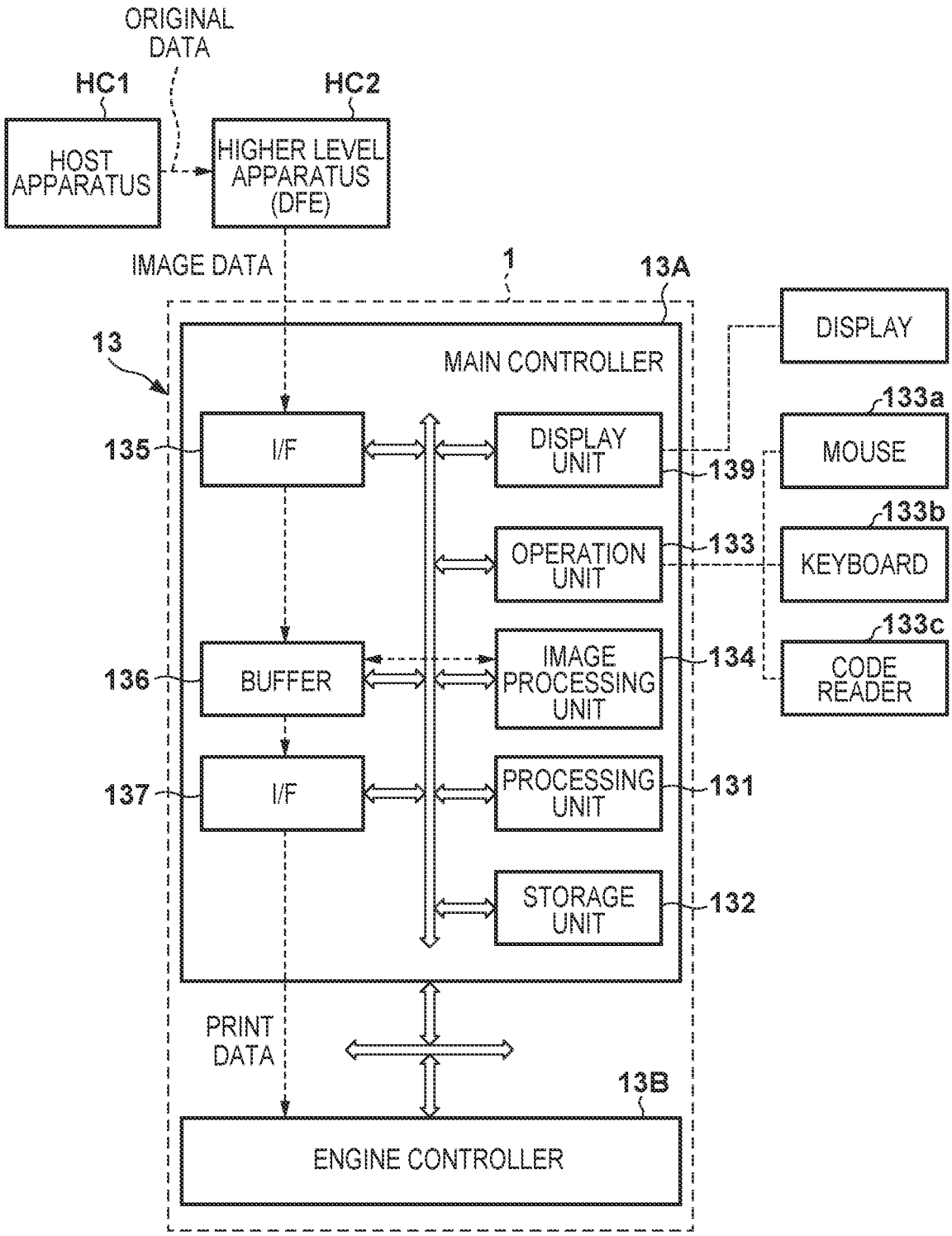
FIG. 3 is a block diagram showing a control system of the printing system in FIG. 1.

A control unit of the printing system 1 will be described next. FIG. 3 is a block diagram showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, a communication I/F 137, and a display unit 139.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. The operation unit 133 is, for example, an input device such as a touch panel, a keyboard 133*b*, a mouse 133*a*, or a code reader 133*c*, and accepts a user instruction. In particular, the code reader functions as an input unit configured to read and input a QR Code® that is a two-dimensional code. The display unit 139 is a display device such as a display or a tablet, and displays a UI (user interface). The display unit 139 also accepts an operation such as a touch on it. Any number of display units 139 and operation units 133 can be provided. The communication method can be either wired communication or wireless communication.

The image processing unit 134 is, for example, a device including an image processing processor. Details of the image processing unit 134 will be described later. The buffer 136 is, for example, a RAM, a hard disk, or an SSD. The communication I/F 135 communicates with the higher level apparatus HC2, and the communication I/F 137 communicates with the engine controller 13B. In FIG. 3, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

The print unit 3 includes the plurality of printheads 30 in the above embodiment, but may include one printhead 30. The printhead 30 need not be a full-line head and may be of a serial type that forms an ink image while scanning the printhead 30 in the Y direction.

The conveyance mechanism of the print medium P may use another method such as a method of conveying the print medium P sandwiched by a roller pair. In the method of conveying the print medium P by a roller pair, a roll sheet may be used as the print medium P, and the roll sheet may be cut after transfer to manufacture the printed product P'.

In the above embodiment, the transfer member 2 is provided on the outer peripheral surface of the transfer drum 41. However, another method such as a method of forming the transfer member 2 into an endless swath shape and causing the transfer member 2 to cyclically run may be used.

Figure 4:
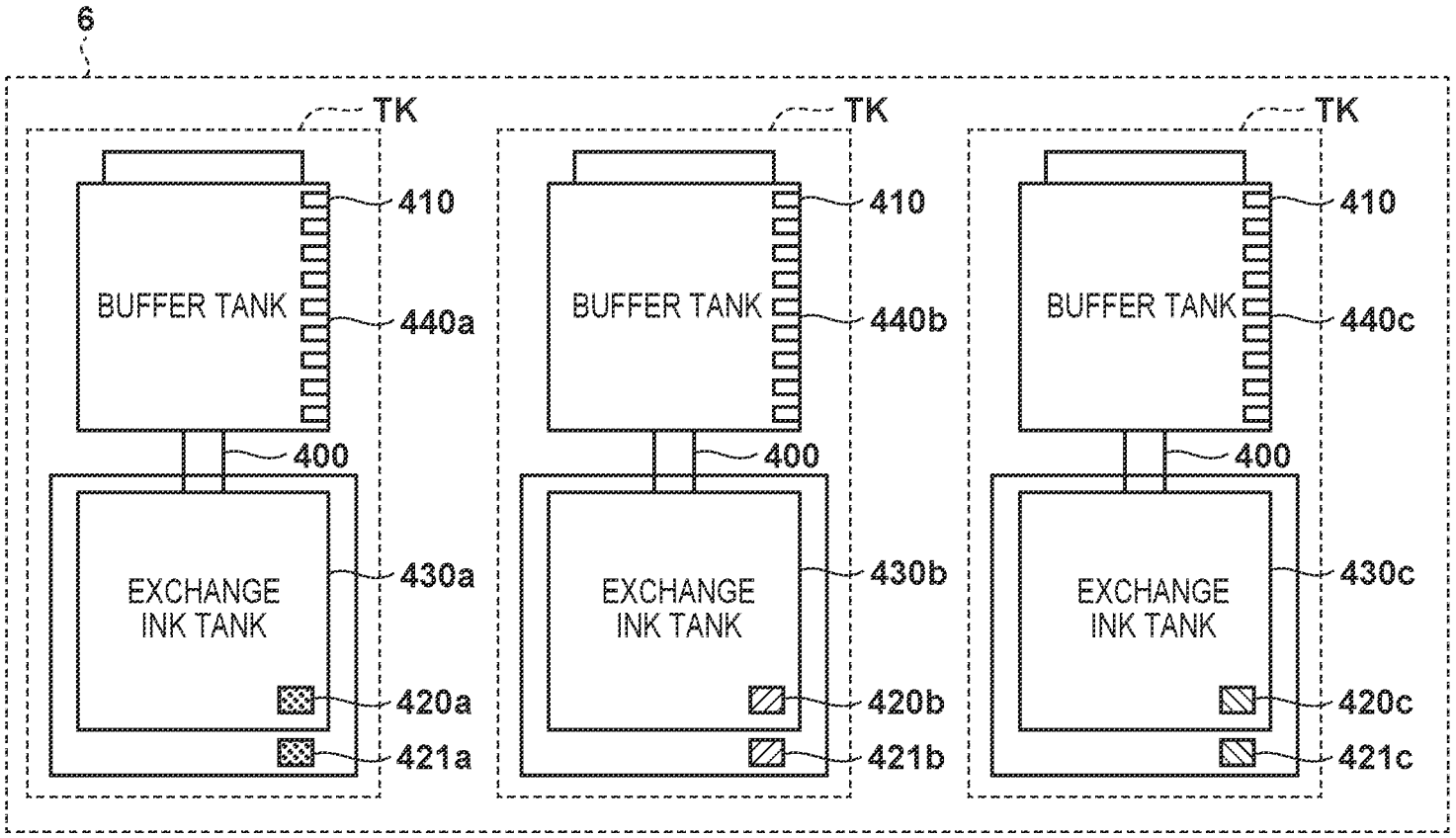
FIG. 4 is a schematic view showing the arrangement of ink tanks.

<FIG. 4: Arrangement of Supply Unit 6>

FIG. 4 is a view showing the arrangement of the supply unit 6 according to this embodiment. The reservoir TK is divided into a buffer tank 440(*a*-*c*) and an exchange ink tank 430(*a*-*c*). Float sensors 410 are installed at nine portions in the buffer tank 440 in accordance with the level of the ink liquid surface, and the ink remaining amount in the buffer tank 440 can be detected in nine levels. For example, the float sensor 410 detects a float floating on the ink in the buffer tank 440. Hence, the ink remaining amount can be detected in nine levels from a state in which the ink remaining amount is zero to a state in which the tank is filled up in accordance with the float sensor that detects the float.

Furthermore, by the float sensor 410 installed in the buffer tank 440, it is determined whether ink suction from the exchange ink tank 430 to the buffer tank 440 is performed. If the suction operation is correctly performed, a timeout time is decided in advance based on a time in which the liquid surface level is assumed to rise by one level. This time can be decided based on, for example, the ink suction amount per unit time and the shape of the buffer tank 440. If the buffer tank 440 has a parallelepiped shape, the predetermined time can be decided based on the base area to a time in which the liquid surface rises by one level. Even if the shape is complex, the ink amount to raise the ink liquid surface by one level can be obtained by giving the sectional area (X-Y plane) with respect to a height (Z-axis) based on the lowest portion of the buffer tank 440 as, for example, a function or a table. The time in which the liquid surface rises by one level can be decided as a real time based on the ink amount and the ink suction amount per unit time. For example, a timeout time obtained by adding an extra time to the thus decided time is set in the timer, a suction motor (not shown) is driven to start suction, and simultaneously, the timer is started. Note that the timer is reset every time an increase in the ink level is detected by the float sensor.

In a case in which the float sensor that should detect the float that has risen in the timeout time has not detected the rise of the liquid surface at all after the elapse of the time, it is determined that the suction is not correctly performed, and an error is generated. That is, a message or the like representing the error is output. In a case in which after the rise of the liquid surface is detected without timeout, the buffer tank 440 is fully filled, or the timeout time has elapsed before that, it is determined that the suction is correctly performed. Hence, after the fill-up state is detected, or the timeout occurs, suction is stopped. In the latter case, that is, in a case in which the timeout time has elapsed before the buffer tank 440 is filled up, the possibility that the exchange ink tank 430 is empty is high. Hence, at the time of completion of suction, the state information of the exchange ink tank 430 held by the main controller 13A is set to a value representing emptiness, and an exchange ink tank emptiness warning is displayed on a UI belonging to the display unit 139. The transition from the state in which the ink can be sucked from the exchange ink tank 430 to the state in which the suction is impossible is detected in this way, thereby detecting that the ink remaining amount of the exchange ink tank 430 is in the empty state. Note that a sensor or the like that detects the remaining amount is not installed in the exchange ink tank 430 and a liquid passageway 400 that connects the exchange ink tank 430 and the buffer tank 440.

QR Codes® 420(*a-c*) and 421(*a-c*) are provided by, for example, pasting on the exchange ink tank 430 and the exchange ink tank installation location as two-dimensional codes associated with them. Each QR code includes information including an identifier, a name, a lot number, and a unique serial number. The identifier includes, for example, information used to identify whether the QR code is a code for the exchange ink tank or a code for the installation location. In addition, the name is ink information representing the type of ink as the contents of the ink tank or the type of ink supplied from the installation location. The ink information includes, for example, the color or type of ink, and it is only necessary to determine the presence/absence of compatibility as the ink. This makes it possible to specify which one of the exchange ink tank and the installation location is associated with each ink type. In addition, a QR code is attached not only to the ink tank but also to another exchangeable part. The QR code is read at the time of exchange, and pieces of information such as the charging information, exchange date/time, and exchange count are held at the timing of pressing an exchange button from the UI. Note that in FIG. 4, since the QR codes are different, suffixes a, b, and c are added to the reference numerals of the exchange ink tank 430 and the buffer tank 440 for a sake of discrimination. However, the suffixes are omitted when explaining a common arrangement.

Since the QR codes 420 and 421 can easily be generated by, for example, a computer and, therefore, can easily be added or changed, the extendability and flexibility are high. Furthermore, it is possible to use general-purpose facility and software to read the QR codes. If the number of ink tanks and the number of types increase, the QR code 421 corresponding to the QR code 420 of the added ink tank is pasted to the location where the ink tank is installed. In addition, when changing the location of an ink tank, it is easy to cope with the change because the QR code 421 need only be pasted to the location after the change.

The information of the read QR code is stored in a part information storage area prepared in a RAM belonging to the storage unit 132. In the part information storage area, an identifier, a name, a lot number, and a unique serial number are stored as part information for one exchangeable part. For each exchangeable part other than the ink tanks, the above-described information is stored in the storage unit 132 when the attached QR code is read once. For each ink tank, the identifier included in the QR code represents one of "exchange ink tank" and "ink tank installation location", and the name (ink type) represents, for example, the type or color of ink (to be referred to as an ink type or ink type information together). Hence, at the time of exchange of the exchange ink tank 430, the QR codes are read. When one represents "exchange ink tank", the other represents "ink tank installation location", and the ink types match, the pieces of QR code information are stored as current part information. This will be described later with reference to FIG. 5.

The printing apparatus main body includes one or a plurality of code readers belonging to the operation unit 133 connected to an information device, and which code reader has performed reading is not discriminated. For this reason, the QR code 420 and the QR code 421 may be read by the same code reader or may be read by different code readers. Note that the code is not limited to the QR code as long as the name and the identifier can be identified. In addition, the reading means is not limited to the code reader as long as it can perform reading corresponding to that. For example, an IC tag and a reader therefor may be used. Additionally, in the device for reading, the display unit and the operation unit may be integrated. For example, when the QR code is read by the camera of a tablet terminal, the reading result is displayed on a UI displayed on the tablet terminal, and an operation necessary for ink tank exchange can be performed on the UI. Furthermore, when a method of recognizing one set of QR codes 420 and 421 is used, the reading need not be performed once for each of the QR codes 420 and 421, that is, twice in total. For example, when a camera is used to perform capturing such that the QR codes 420 and 421 are included, and image recognition processing is performed, it is possible to read the two QR codes by one operation and determine whether exchange is possible.

If it is determined that the exchange ink tank 430 is in a suction start enable state, and the ink remaining amount of the buffer tank 440 is in a state in which ink suction from the exchange ink tank 430 is necessary, ink suction is started at any time via the liquid passageway 400. Once the suction is started, the ink in the exchange ink tank 430 is completely sucked into the buffer tank 440. At the same time that the exchange ink tank 430 becomes empty, the exchange ink tank 430 emptiness warning is made, and a suction completion state is obtained. If the transition to the suction completion state has occurred, the suction is never performed using the same exchange ink tank. Only when the user designates (presses) an exchange completion button on the UI displayed on the display unit 139 does the state transition to the suction start enable state, and ink suction from the exchange ink tank 430 to the buffer tank 440 can be started at any time. That is, suction is not started unless a predetermined display item representing the completion of exchange of the exchange ink tank 430 is designated.

Figure 5:
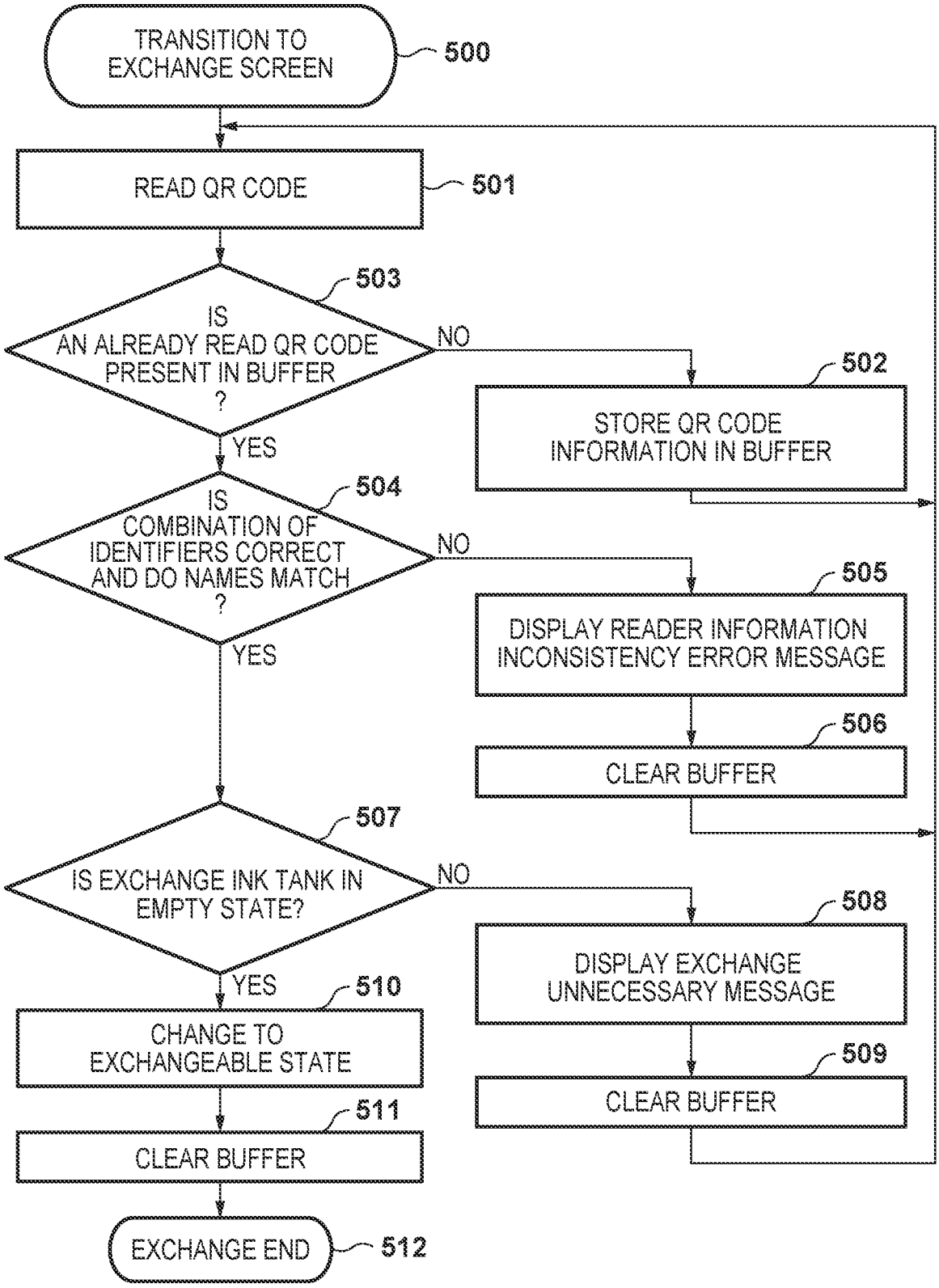
FIG. 5 is a flowchart of an ink tank exchange procedure.

<FIG. 5: Exchangeability Determination Procedure>

FIG. 5 shows an ink tank exchangeability determination procedure. The procedure shown in FIG. 5 is implemented by, for example, executing a program stored in the storage unit 132 by the processing unit 131 (more specifically, a processor or the like). In addition, this procedure is executed in a state in which the exchange ink tank emptiness warning is displayed on the UI (that is, in a state in which an exchange screen is displayed).

In step 501, the QR code of the exchange ink tank or the QR code of the exchange ink tank installation location is read. Additionally, in this step, the pieces of information of the name and identifier (installation location/ink tank main body) are extracted from the read QR code. Note that the exchange ink tank may be the first, or the exchange ink tank installation location may be the first. The reading order is not particularly limited. The QR code read in step 501 includes an identifier, a name, a lot number, a unique serial number, and the like as ink tank associated QR code information. These pieces of information will sometimes be referred to as QR code information or ink tank information hereinafter.

Figure 6:
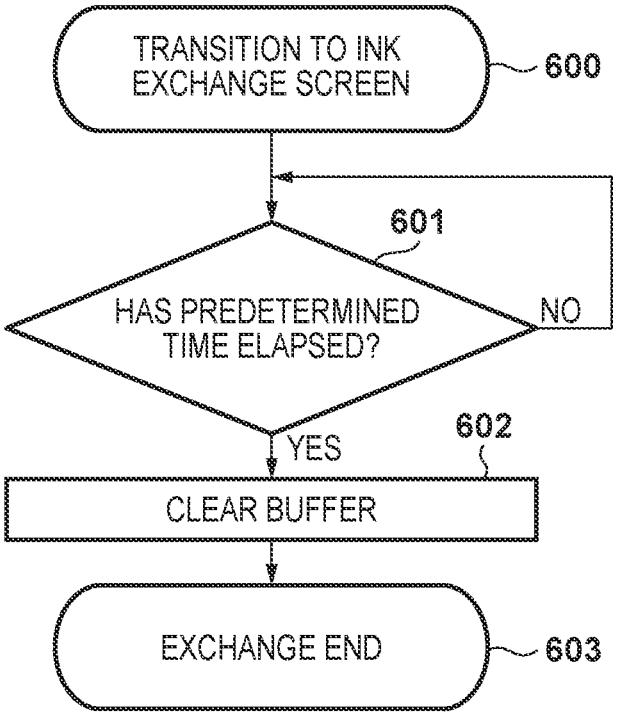
FIG. 6 is a flowchart of the ink tank exchange procedure.

In step 503, it is determined whether an already read QR code is present in a buffer. The buffer is a holding buffer that is prepared in a RAM belonging to the storage unit 132 to hold the read QR code information associated with the ink tank. In a state in which the QR code of only one of the exchange ink tank and the exchange ink tank installation location is read, ink tank information is not stored in the buffer yet. Hence, upon determining in step 503 that ink tank information is not stored in the buffer, in step 502, the QR code information read in step 501 is stored in the buffer, and the process returns to step 501 again to read the QR code. Furthermore, in step 502, the timer in which a predetermined time is set before the transition to step 501 is started. This timer is canceled if the QR code is read in step 501. If timeout occurs, the procedure shown in FIG. 6 is executed.

On the other hand, if read QR code information already exists in the buffer in step 503, the process advances to step 504. In step 504, the QR code information read in step 501 is compared with the immediately preceding QR code information stored in the buffer in step 502. It is determined whether the names of the QR codes match, and whether one identifier is "exchange ink tank", and the other is "exchange ink tank installation location". That is, compatibility of the exchange ink tank to the tank installation location is checked. If the two conditions are satisfied, the process branches to step 507.

For example, if the QR code of the exchange ink tank of cyan and the QR code of the exchange ink tank of magenta are read in step 501, the names "ink cyan" and "ink magenta" are different. Hence, in step 504, the determination ends with "NO". Additionally, in a case in which the exchange ink tank of cyan is read twice, if the names match, but the identifiers are the same, for example, if the identifiers are "exchange ink tank" and "exchange ink tank", the conditions are not satisfied, and the determination ends with "NO". If the names and identifiers are not in correct combination, as described above, the process advances to step 505 to display an error message on the UI. After that, in step 506, the buffer is cleared, and the process returns to step 501.

Upon determining in step 504 that the QR code reading is performed in a correct combination, the process advances to step 507 to determine whether the exchange ink tank is in the empty state. Upon determining that the exchange ink tank is not empty, the process advances to step 508 to display an exchange unnecessary message on the UI. After that, in step 509, the buffer is cleared and returned to 0. Note that even if the procedure shown in FIG. 5 is started in a state in which the exchange ink tank emptiness warning is displayed on the UI, the operation before exchange may be performed for an ink tank that is not in the empty state. For example, such unwanted exchange can be prevented in step 507.

Note that when performing the determination of step 507, the determination may be done by referring to the state of the exchange ink tank. However, the state of the exchange ink tank may be detected anew. In the latter case, if the exchange ink tank is already empty, the liquid surface in the buffer tank does not rise even if ink suction is attempted. Hence, in step 507, if the rise of the liquid surface cannot be detected by the float sensor even if the ink is sucked from the exchange ink tank (that is, if timeout occurs), it can be determined that the exchange ink tank is in the empty state. Note that "empty state" includes not only a state in which no ink remains in the exchange ink tank at all but also a state in which ink remains in an amount smaller than a minimum amount that enables suction. That is, "the exchange ink tank is in the empty state" indicates a state in which the remaining amount in the exchange ink tank is smaller than the amount that enables suction.

Upon determining in step 507 that the exchange ink tank is in the empty state, the process advances to step 510 to decide that the exchange ink tank is in an exchangeable state. Then, in step 510, to show that the exchange ink tank can be exchanged (or may be exchanged), the exchange completion button, which is displayed on the UI, is displayed in an enable state in which the button can be designated (pressed). For example, the display of the exchange completion button is changed from a disable state in which the button is grayed out and cannot be designated to the enable state in which the button can be designated. Furthermore, in step 510, after the exchange completion button is displayed in the enable state in which the button can be designated, the timer in which a predetermined time is set is started. This timer is canceled if the exchange completion button is pressed. If timeout occurs, the procedure shown in FIG. 7 is executed.

After that, in step 511, the QR code information in the buffer is cleared. In step 512, the processing is ended. Note that in step 511, if necessary, the QR code information determined as a correct combination may be stored as the QR code information of the currently attached part. Additionally, in step 510, the operator installs the exchange ink tank whose QR code is read in the installation location where the QR code is read.

Furthermore, if the exchange completion button is pressed, a state in which ink suction from the exchange ink tank after the exchange is possible is set. In addition, ink suction from the exchange ink tank after the exchange may be started to start transfer of ink to the buffer tank.

Figure 7:
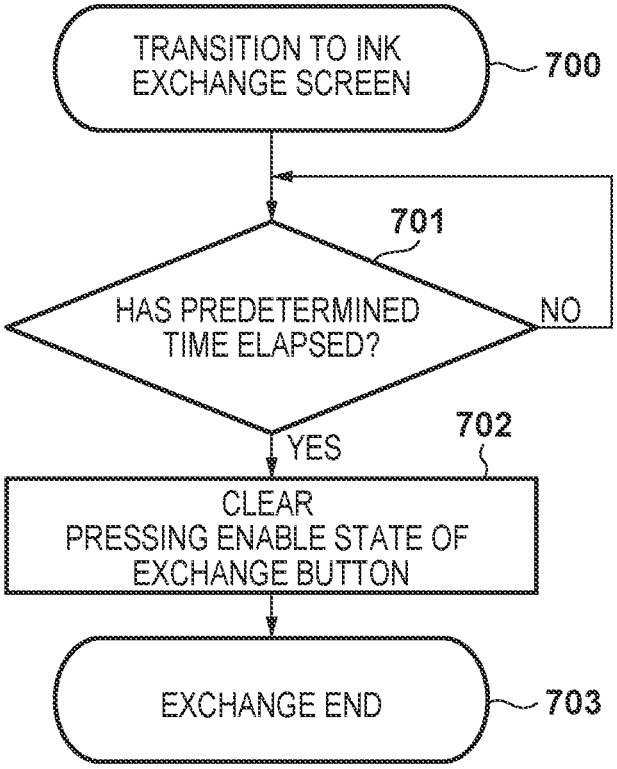
FIG. 7 is a flowchart of the ink tank exchange procedure.

<FIGS. 6 and 7: Timeout Determination>

FIGS. 6 and 7 show timeout determination procedures. In step 601, if it is determined that a predetermined time has elapsed after the storage of the information of a given QR code (that is, if timeout of the timer has occurred), the QR code information in the buffer is cleared, and the processing is ended. Additionally, in step 701, if the names of the QR codes of the exchange ink tank and the exchange ink tank installation location match, and a predetermined time has elapsed in a state in which the exchange completion button is in a pressing enable state (that is, if timeout of the timer has occurred), the pressing enable state is cleared. In both cases, the empty state of the exchange ink tank is not solved.

It is therefore possible to newly reexecute the processing from step 501 of FIG. 5 and reattempt the exchange of the exchange ink tank.

In the above-described way, in the printing apparatus according to this embodiment, when exchanging the exchange ink tank, the compatibility of the exchange ink tank is confirmed by collating pieces of ink type information assigned to the exchange ink tank and its installation location. This can prevent the exchange ink tank from being erroneously attached. In addition, when a QR code corresponding to each of the ink tank and its installation location is used as the ink type information, an existing resource can be used, and the cost to prevent erroneous ink tank attachment can be reduced. Furthermore, at the time of ink tank exchange, it is confirmed that the ink tank is empty. This can prevent unwanted exchange and prevent waste of ink.

Note that this embodiment concerns a large printing apparatus. However, the invention of this embodiment can be applied irrespectively of its scale. This embodiment can also be applied not only to ink but also to a toner cartridge. In addition, the printing material is not limited to ink or toner, and this embodiment can also be applied to a print medium such as a sheet by replacing the exchange ink tank and its installation location with a sheet bundle and a sheet cassette, respectively. Furthermore, a normal barcode can also be used in place of the QR code that is a two-dimensional code. A chip such as an IC tag can also be used.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-148711, filed Aug. 7, 2018, which is hereby incorporated by reference herein in its entirety.

What is claimed is:

1. A printing apparatus that performs printing by using different types of ink and replenishes the ink by exchanging a corresponding one of different exchange ink tanks attached to the printing apparatus at different installation locations in correspondence with the different type of ink, the printing apparatus comprising:

at least one processor configured to cause the printing apparatus to perform operations including:

receiving first code information by reading a first code and receiving second code information by reading a second code, the first code information including first ink information and first identification information, and the second code information including second ink information and second identification information;

detecting whether a state of a current exchange ink tank attached at an installation location has changed to an empty state; and performing determination processing as to whether the current exchange ink tank can be exchanged with a new exchange ink tank, wherein the determination processing includes (1) identifying processing that determines whether the first identification information identifies a new exchange ink tank and the second identification information identifies an installation location, and (2) comparison processing that determines whether ink types represented by the first ink information and the second ink information are compatible, wherein, in a case in which the current exchange ink tank is detected to be in the empty state, if (1) the identifying processing determines that the first identification information identifies the exchange ink tank and the second identification information identifies the installation location, and (2) the comparison processing determines that the first ink information and the second ink information are compatible, the determination processing determines that the current exchange ink tank can be exchanged with the new exchange ink tank, and wherein, in a case in which the current exchange ink tank is detected to be in the empty state, if (1) the identifying processing does not determine that the first identification information identifies the exchange ink tank and the second identification information identifies the installation location, or (2) the comparison processing does not determine that the first ink information and the second ink information are compatible, the determination processing determines that the current exchange ink tank cannot be exchanged with the new exchange ink tank.

2. The apparatus according to claim 1, wherein in the determination processing, the first ink information included in a tag provided on the new exchange ink tank is compared with the second ink information included in a tag provided on the installation location.

3. The apparatus according to claim 2, wherein each tag further includes identification information representing which one of the new exchange ink tank and the installation location is provided with the tag, and based on the identification information, it is specified whether the read first or second code includes the first ink information or the second ink information.

4. The apparatus according to claim 3, wherein if the identification information represents that the tags are both provided on the new exchange ink tank or represent that the tags are both provided on the installation location, information representing an error is output.

5. The apparatus according to claim 3, wherein each tag indicates a two-dimensional code on one of the new exchange ink tank and the installation location, and each two-dimensional code is read, thereby the first or second ink information and the first or second identification information are input.

6. The apparatus according to claim 1, wherein upon determining that the first ink information and the second ink information are compatible, and determining that the current exchange ink tank is not in the empty state, a message representing that exchange is unnecessary is output.

7. The apparatus according to claim 1, wherein upon determining that the current exchange ink tank can be exchanged with the new exchange ink tank, a display item that allows a user to designate that the exchange of the current exchange ink tank with the new exchange ink tank is completed is displayed on a display unit, and if the user designates the display item, a state in which supply of ink from the exchange ink tank attached to the installation location is possible is set.

8. The apparatus according to claim 7, further comprising a buffer tank configured to store the ink transferred from the exchange ink tank attached to the installation location, wherein if the display item is designated, the supply of the ink from the exchange ink tank attached to the installation location to the buffer tank is started.

9. The apparatus according to claim 1, wherein a transition from a state in which the ink can be sucked from the current exchange ink tank to a state in which the ink cannot be sucked is detected in the detecting, thereby it is detected that the state of the current exchange ink tank has changed to the empty state.

10. The apparatus according to claim 1, wherein the operations further include forming an image on a sheet by forming the image on a transfer member by discharging the ink and transferring the image on the transfer member to the sheet.

11. A control method of a printing apparatus that performs printing by using different types of ink and replenishes the ink by exchanging a corresponding one of different exchange ink tanks attached to the printing apparatus at different installation locations in correspondence with the different types of ink, the control method comprising:

receiving first code information by reading a first code and receiving second code information by reading a second code, the first code information including first ink information and first identification information, and the second code information including second ink information and second identification information;

detecting whether a state of a current exchange ink tank attached at an installation location has changed to an empty state; and performing determination processing as to whether the current exchange ink tank can be exchanged with a new exchange ink tank, wherein the determination processing includes (1) identifying processing that determines whether the first identification information identifies a new exchange ink tank and the second identification information identifies an installation location, and (2) comparison processing that determines whether ink types represented by the first ink information and the second ink information are compatible, wherein, in a case in which the current exchange ink tank is detected to be in the empty state, if (1) the identifying processing determines that the first identification information identifies the exchange ink tank and the second identification information identifies the installation location, and (2) the comparison processing determines that the first ink information and the second ink information are compatible, the determination processing determines that the current exchange ink tank can be exchanged with the new exchange ink tank, and wherein, in a case in which the current exchange ink tank is detected to be in the empty state, if (1) the identifying processing does not determine that the first identification information identifies the exchange ink tank and the second identification information identifies the installation location, or (2) the comparison processing does not determine that the first ink information and the second ink information are compatible, the determination processing determines that the current exchange ink tank cannot be exchanged with the new exchange ink tank.

* * * * *